US005556323A

United States Patent [19]

Luther et al.

[11] Patent Number: 5,556,323

[45] Date of Patent: Sep. 17, 1996

[54] METHOD OF POLISHING OPTICAL CONNECTORS

[75] Inventors: James P. Luther; Dennis M. Knecht; Sherrh C. Reinhardt; Karen Petzold, all of Hickory, N.C.

[73] Assignee: Siecor Corporation, Hickory, N.C.

[21] Appl. No.: 268,981

[22] Filed: Jun. 30, 1994

[51] Int. Cl.[6] ..... B24B 1/00

[52] U.S. Cl. ..... 451/28; 451/36; 451/57

[58] Field of Search ..... 451/28, 36, 37, 451/57; 51/328

[56] References Cited

U.S. PATENT DOCUMENTS

| | | | |
|---|---|---|---|
| 3,715,842 | 2/1973 | Tredinnick et al. | 51/308 |
| 3,922,393 | 11/1975 | Sears, Jr. | 51/308 |
| 4,022,625 | 10/1977 | Shelton | 51/309 R |
| 4,057,939 | 11/1977 | Basi | 451/28 |
| 5,078,801 | 1/1992 | Malik | 451/288 |
| 5,136,820 | 8/1992 | Luther . | |
| 5,264,010 | 11/1993 | Brancaleoni et al. | 51/308 |

OTHER PUBLICATIONS

Examination of the polished surface character of fumed silica, Applied Optics vol. 31, No. 34 (Dec. 1, 1992). p. 7164–7172.

*Primary Examiner*—Maurina T. Rachuba
*Attorney, Agent, or Firm*—Wesley T. Noah

[57] ABSTRACT

A method for polishing the distal end of a fiber optic connector. The distal end is first polished in the presence of an aqueous slurry comprising two different powders to bring a glass surface and a ferrule surface to a substantially common plane, and subsequently polished in the presence of an acidic solution to prevent the attachment of hydrated silica particles to the ferrule face.

1 Claim, 1 Drawing Sheet

METHOD OF POLISHING OPTICAL CONNECTORS

BACKGROUND OF THE INVENTION

Light waveguide communication cables are increasingly used in the modern network. Practical network planning must take into account that a message may need to travel over a number of different connected cables between the sender and receiver of a message. Cable or light waveguide fiber joints are often made using remateable connectors instead of permanent splices to give needed flexibility. Therefore, the efficient transfer of optical energy ultimately depends upon connection joints having the minimum optical loss. Accuracy is very important, and tolerances are often measured in terms of microns.

Return loss from connectors can degrade transmitter or receiver performance in high-speed and multichannel analog systems. To avoid an excessive link power penalty, the return loss of individual connectors is sometimes specified.

Various grinding and polishing machines have been proposed to prepare connectors having a desired end face surface. Examples include Saito, et al., U.S. Pat. No. 5,007,209; Moulin, U.S. Pat. No. 4,905,415; Clark, U.S. Pat. No. 4,492,060; and Tamulevich, U.S. Pat. No. 4,272,926.

Mechanical grinding or polishing of the distal end of a light waveguide connector by use of a grinding pad having fine diamond or aluminum particles in the presence of an aqueous slurry of silicon dioxide particles was disclosed in Luther, U.S. Pat. No. 5,136,820. Cerium oxide is a known agent for use in glass polishing.

SUMMARY OF THE INVENTION

Mechanical polishing in the presence of an aqueous slurry containing silicon dioxide powder as described in U.S. Pat. No. 5,136,820 is effective to remove a hard zirconia ceramic ferrule at a rate faster than the rate of removal of the glass enclosed by the ferrule. Cerium oxide powder, like many polishing abrasives, is effective to remove the glass material at a rate faster than the rate of removal of the zirconia ceramic ferrule. To achieve a connector distal end having a desired balance of the rate of removal of the ferrule material and the glass material, the optical connector distal end is mechanically polished in the presence of an aqueous slurry comprising a first powder such as cerium oxide and a second powder such as silicon dioxide, the first powder if used alone removing the glass material more rapidly than the ceramic material, and the second powder if used alone removing the ceramic material more rapidly than the glass material. The polishing slurry can be adjusted to result in an optical connector in which the glass light waveguide and ceramic distal surfaces are substantially in a common plane. It is found that polishing using a mixture of both powders can achieve a tolerance of −0.05 micrometers to +0.1 micrometers.

It has also been found that the subsequent polishing of the distal end in the presence of an acidic solution further improves the return loss performance of the coupler being polished. It is believed that the acidic solution prevents the attachment of hydrated silica particles on the face of the light waveguide distal end, and the slight polishing in the acidic solution leaves the end face free of the slight build-up. A pH of equal to or less than 4 has been found to be sufficient to produce the desired effect.

BRIEF DESCRIPTION OF THE DRAWING

The description of the, preferred embodiment is made with reference to the single FIG. 1 showing a side elevation view of the polishing according to the invention of a light waveguide connector.

DETAILED DESCRIPTION OF THE INVENTION

Figure 1:
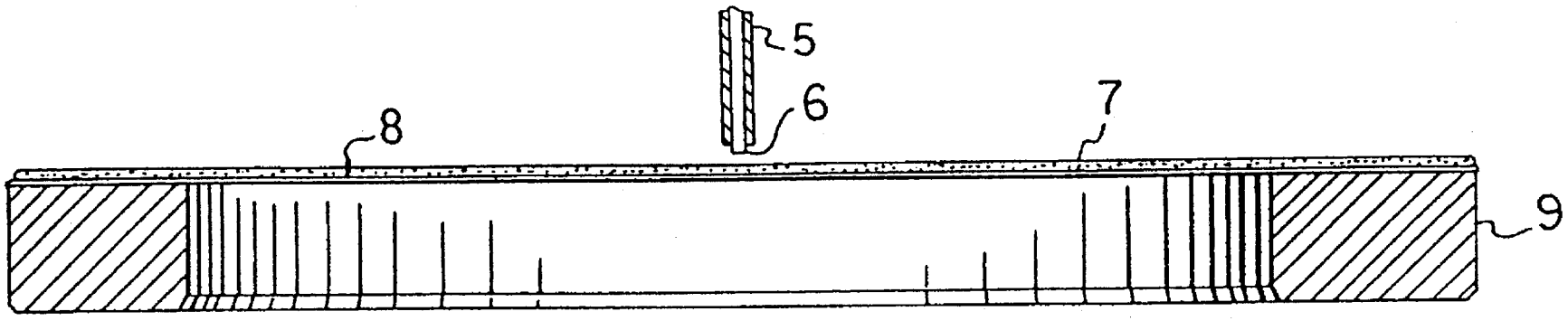

Referring to FIG. 1, ferrule 5, usually made of a ceramic or a metal alloy, holds therein a light waveguide having a distal end 6. The distal ends of the ferrule and glass light waveguide are to be polished in the presence of aqueous solution 7 by pad 8 suspended over polishing wheel 9.

A sample of twenty glass in ceramic distal ends were mechanically polished for twenty seconds to achieve a substantially common end face plane in a first solution of 1000 ml of water, 500 ml of silicon dioxide powder, and 1 cc of cerium oxide powder. The first solution had a pH of 7. The average return loss of the sample after polishing in the first solution was 49.59 dB. The sample was then mechanically polished for 10 seconds in a second solution of 1000 ml of water having therein 500 ml of silicon dioxide powder. The pH of the second solution was 4. The average return loss of the sample after polishing in the second solution improved to 57.58 dB.

What is claimed is:

1. A method of manufacturing a glass waveguide and ceramic ferrule assembly for use in an optical fiber connector, comprising the steps of:

(a) inserting a distal end of the waveguide into the ferrule so that the waveguide protrudes slightly beyond the end of the ferrule;

(b) polishing the end of the waveguide and ferrule assembly with an aqueous slurry with a neutral pH and comprising silicon dioxide and cerium oxide; and (c) then polishing the waveguide and ferrule assembly distal end with a solution having a pH of about 4 or less.

* * * * *